US012440891B2

(12) United States Patent
Freire et al.

(10) Patent No.: US 12,440,891 B2
(45) Date of Patent: Oct. 14, 2025

(54) REFRACTORY CASTING NOZZLE FOR A CHANGING DEVICE ARRANGED AT THE OUTLET OF A METALLURGICAL VESSEL

(71) Applicant: Refractory Intellectual Property GmbH & Co. KG, Vienna (AT)

(72) Inventors: Rubens Alves Freire, Belo Horizonte (BR); Fabricio Junior Silva, Contagem (BR); Danilo Cunha Martins, Belo Horizonte (BR); Rodrigo Donizete Turqueti Pedrozo, Belo Horizonte (BR)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 548 days.

(21) Appl. No.: 17/756,837

(22) PCT Filed: Dec. 4, 2019

(86) PCT No.: PCT/EP2019/083694
§ 371 (c)(1),
(2) Date: Jun. 3, 2022

(87) PCT Pub. No.: WO2021/110259
PCT Pub. Date: Jun. 10, 2021

(65) Prior Publication Data

US 2023/0027735 A1 Jan. 26, 2023

(51) Int. Cl.
*B22D 41/56* (2006.01)
*B22D 41/50* (2006.01)

(52) U.S. Cl.
CPC ..... *B22D 41/56* (2013.01); *B22D 41/502* (2013.01)

(58) Field of Classification Search
CPC ..... B22D 41/56; B22D 41/502; B22D 41/50
See application file for complete search history.

(56) References Cited

U.S. PATENT DOCUMENTS 4,693,401 A * 9/1987 Nishimura ..... B22D 41/56 222/600
4,887,748 A * 12/1989 Hicks ..... B22D 41/28 222/606

(Continued)

FOREIGN PATENT DOCUMENTS

CN 2298889 Y * 12/1998
EP 2368654 A1 9/2011

(Continued)

*Primary Examiner* — Keith D. Hendricks
*Assistant Examiner* — Moriah S. Smoot
(74) *Attorney, Agent, or Firm* — Brian Roffe

(57) ABSTRACT

Refractory casting nozzle for a changing device arranged at the outlet of a metallurgical vessel is provided with a top side refractory plate, which is provided with an abutting surface at each of two opposing end faces. During a change, the casting nozzle can either be moved against the one abutting surface of a top side plate of an adjacent casting nozzle or be pushed out from this casting nozzle. This top side plate is provided, in the one abutting surface, with a centering element protruding on both sides of this and in the opposite abutting surface with a bevelling on both sides, designed such that, during a change, the casting nozzle cooperates, with its centering elements with the bevellings of the adjacent identically designed casting nozzle, thus bringing about a guiding of the two casting nozzles.

17 Claims, 2 Drawing Sheets

(56) References Cited

U.S. PATENT DOCUMENTS

| | | | | |
|---|---|---|---|---|
| 4,896,801 | A | 1/1990 | Lothmann et al. | |
| 5,173,199 | A | 12/1992 | Bruckner et al. | |
| 5,494,201 | A | 2/1996 | Szadkowski | |
| 5,688,425 | A | 11/1997 | Yamamoto et al. | |
| 8,887,969 | B2 | 11/2014 | Steiner et al. | |
| 9,314,841 | B2 | 4/2016 | Steiner et al. | |
| 2014/0203051 | A1 * | 7/2014 | Taburiaux | B22D 41/56<br>222/600 |
| 2015/0315664 | A1 | 11/2015 | Alves Freire et al. | |

FOREIGN PATENT DOCUMENTS

| | | | | |
|---|---|---|---|---|
| JP | H10-286658 | A | 10/1998 | |
| JP | 2005211905 | A | 8/2005 | |
| WO | WO-2011113598 | A1 * | 9/2011 | B22D 41/34 |
| WO | 2018145772 | A1 | 8/2018 | |
| WO | 2019079870 | A1 | 5/2019 | |
| WO | 2021110259 | A1 | 6/2021 | |

* cited by examiner

REFRACTORY CASTING NOZZLE FOR A CHANGING DEVICE ARRANGED AT THE OUTLET OF A METALLURGICAL VESSEL

FIELD OF THE INVENTION

The invention relates to a replaceable refractory casting nozzle for a changing device arranged at the outlet of a metallurgical vessel, with a top side refractory plate, which is provided with an abutting surface at each of two opposing end faces which, during a change, cause the casting nozzle either to strike against the one abutting surface of the top side plate of an adjacent casting nozzle or to be able to be pushed out from this casting nozzle.

BACKGROUND OF THE INVENTION

Such refractory casting nozzles of the type as used are for example casting or submerged nozzles, metering nozzles or the like in corresponding changing devices in tundish, ladles or other vessels when casting molten material. Due to the casting temperatures, they are subjected to strong wear, and need to be replaced relatively often. Therefore, in strand casting systems, such changing devices are often used at the outlet of the vessels into which the casting nozzles are pressed in displaceable manner. In the changing process, in each case a new casting nozzle is pushed in by a mechanical drive and simultaneously the spent casting nozzle is pushed out from the casting position.

European patent publication EP-A-2 448 700, which is considered to correspond to U.S. Pat. Nos. 8,887,969 and 9,314,841, discloses a submerged nozzle that comprises an elongated, tubular part defining a lower part of a pouring channel with a central longitudinal axis, a plate-like part, provided with a flow-through opening between its surface opposite the tubular part and its section adjacent said tubular part. A casting tube changing device includes pressable pressing elements that can be pressed onto guide surfaces of the casting tube, whereby the casting tube includes guide surfaces on the lower side of the plate being arranged to both sides of the tubular part and being directed downwardly at an angle and forming a downwardly tapering plate cross-section. The pressing elements are respectively provided with a head curved in stages or convexly in the adjustment direction of the casting tube and can be pressed onto a guide surface of the casting tube curved in their longitudinal direction respectively in the adjustment direction.

In practice, it has been shown that, with the changing devices known thus far, a disadvantageous wobbling or wiggling of the casting nozzles is caused during the changing process. Occasionally, in a casting operation this has the consequence that a slide closure is used at the outlet for regulated casting of the molten material, the required precise coaxial alignment of the orientation of the casting nozzle differs from that of the slide plate of the slide closure and this has a negative effect on the control precision.

OBJECTS AND SUMMARY OF THE INVENTION

An object of the invention is to avoid these disadvantages and to produce a casting nozzle of the type named at the outset, which uses simple means to prevent or reduce the wobbling or wiggling of the casting nozzles during the changing process considerably.

This object is achieved, according to the invention, wherein the top side refractory plate of the refractory casting nozzle is provided, in the one abutting surface, with a centering element protruding on both sides of this and in the opposite abutting surface with a bevelling on both sides, designed such that, during a change, the casting nozzle cooperates, with its centering elements with the bevellings of the adjacent identically designed casting nozzle, thus bringing about a guiding of the two casting nozzle.

Using this provision of centering elements or corresponding bevellings in the respective top side plate of the casting nozzles, an approximately fixed guiding of the two can be effected during a change in casting, with the result that it is not possible for any wobbling or wiggling of same to occur.

Within the scope of the simplest possible design it is also provided, according to the invention, that the top side plate of the casting nozzle is designed rectangular and preferably square, wherein the bevellings are placed in the one side corner regions and the centering elements in the other side corner regions, and the centering elements are bevelled corresponding to the angle of inclination of the bevellings. Reciting that the top side plate of the casting nozzle is rectangular or preferably square means that the abutting surfaces are perpendicular to opposed side surfaces thereby forming corner regions between each of the abutting surfaces and the adjacent side surfaces. Each of the bevellings is thus in a respective one of the corner regions between one of the abutting surfaces and the opposed side surfaces and the centering elements are thus in a respective one of the corner regions between the other one of the abutting surfaces and the opposed side surfaces.

In order to optimize the centering or guiding effect, the angle of inclination of the bevellings according to the invention is measured such that, during the changing process, the pushing forces acting thereupon are directed into the center of the flow through of the casting nozzle. In this sense it is advantageous if the angle of inclination of the bevellings is between 30° to 60°, preferably 45°. It is thereby ensured that the force resulting from the centering elements acts against the nozzle center during the changing process, and simultaneously the casting nozzles are prevented from being able to be wedged by these centering elements.

Moreover, it is advantageous for manufacturing reasons if the centering elements of the casting nozzle are formed as part of a sheet jacket surrounding at least the top side plate.

The invention furthermore provides that the centering elements and the bevellings cooperating with same are measured such that, during the changing process, the top side of the casting nozzles is always in tight contact with the abutting surfaces. In this way, no gap occurs between these surfaces, and molten material cannot flow in or out of same during operation, when a change takes place.

Moreover, it is expedient for the operational safety of the casting nozzles if the length of the abutting surfaces of the plates of the casting nozzles transverse to the displacement direction of same is measured to be greater than the hole diameter thereof.

The casting nozzle according to the invention also makes it possible for the bottom side of the plate thereof to be provided with bearing surfaces for the mechanical guiding and lifting push means of the changing device.

The cooperation of both the centering elements and the front side guide elements in the push rod of the linear actuator of the changing device with the bevellings causes fixed guiding and centering of the casting nozzles during the changing process. Wiggling or wobbling of the casting nozzles is thus largely ruled out, and optimal functionality is ensured during the changing process.

BRIEF DESCRIPTION OF THE DRAWINGS

The invention and further advantages of same are explained in more detail below using an embodiment example, with reference to the drawings.

DETAILED DESCRIPTION OF THE INVENTION

Figure 1:
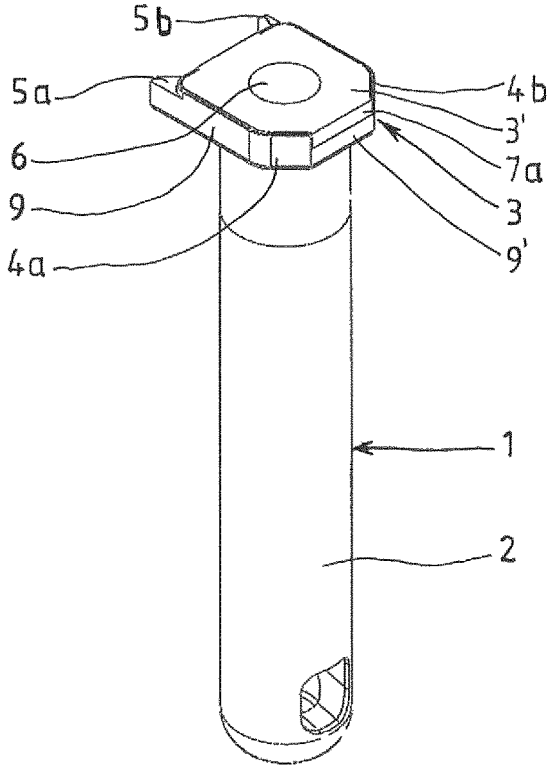
FIG. 1 is a perspective view of a refractory casting nozzle according to the invention.
Figure 2:
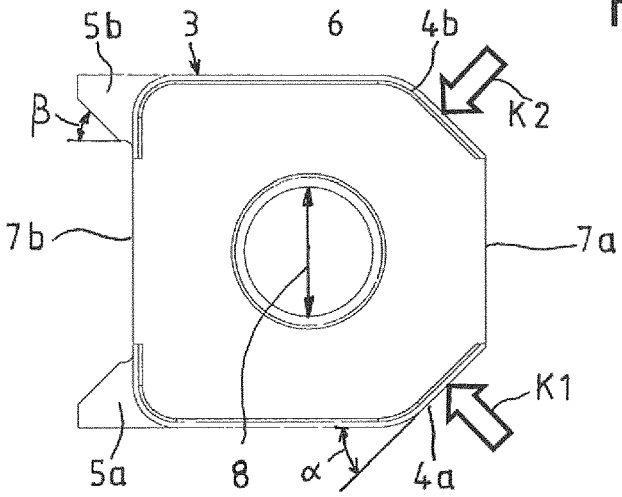
FIG. 2 is a top view of the top side refractory plate of the casting nozzle according to FIG. 1.
Figure 3:
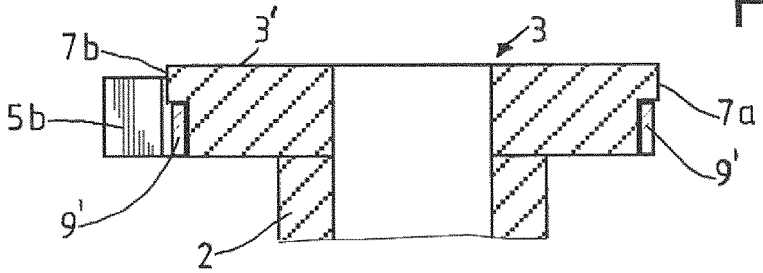
FIG. 3 is a partial longitudinal view of the casting nozzle according to FIG. 1 at the top side of the refractory plate.

The refractory casting nozzle 1 shown in FIGS. 1-3 is provided as a dipping tube for a strand casting system casting molten steel. It is made from refractory ceramic material in one or more parts and is composed of a tube or tubular part 2 with a flow through 6 and a top side refractory plate 3 with a sheet jacket 9. It is suitable as a casting or dipping tube, metering nozzle or the like in corresponding changing devices in tundish, ladles or other containers when casting molten material.

The top side refractory plate 3 of the casting nozzle 1 has, at the top, a sliding surface 3' and an abutting surface 7*a*, 7*b* each for two opposing end surfaces, which serve to ensure that the casting nozzle 1 can be brought into tight contact against respectively an abutting surface of the top side plate of an adjacent casting nozzle during a change.

According to the invention, this top side plate 3 is provided, in the one abutting surface 7*b*, with a centering element 5*a*, 5*b* protruding on both sides of same, and in the opposite abutting surface 7*a* with a bevelling 4*a*, 4*b* on both sides of same.

The bevellings 4*a*, 4*b* are arranged in the one side corner regions of the top side plate 3. They have an angle of inclination α as shown of preferably 45° and are positioned to one another such that, during the changing process, the pushing forces K1, K2, which are introduced for instance by a push rod of a linear actuator of a changing device, acting thereupon inwards of the casting nozzle 1 and extending parallel to the plane of the sliding surface of the top side plate 3. As shown in FIG. 2, the angle of inclination α is defined as an angle between a plane parallel to the lateral side surface of the sheet jacket 9 or side surface of the top side refractory plate 3 of the casting nozzle 1 that underlies that portion of the sheet jacket 9, and a plane parallel to the surface of the sheet jacket 9 that overlies the bevelling 4*a*. A similar angle of inclination is defined for bevelling 4*b* on the opposite side of the abutting surface 7*a*.

Instead of these pushing forces K1 or K2 in this direction inwards it could be used a pushing force in the moving direction, which would be acting on the abutting surface 7*a* of the top side plate 3 or visa vis on the abutting surface 17*b* of the other plate 13 in the opposite direction, thus perpendicularly on the respective abutting surface 7*a*, 17*b*.

The centering elements 5*a*, 5*b* are positioned for their part in the front end regions of the top side plate 3 as protruding parts of the sheet jacket 9. As can be seen from FIG. 2, they are designed wedge-shaped, for instance triangular or similar, wherein the angle of inclination β thereof is equal to that of the bevellings 4*a*, 4*b*. With the same angle of inclination, the bevelling 4*a*, 4*b* on each side of the abutting surface 7*b* has a cooperating or complementary profile to the centering element 5*a*, 5*b* on the respective side of the abutting surface 7*a*. As shown in FIG. 2, the angle of inclination β is defined as an angle between a plane parallel to the angled contact surface of the centering element 5*b* (on an opposite side of the wedge-shaped centering element 5*b* from the side that is alongside the side surface of the top side refractory plate 1), and a plane parallel to the lateral side surface of the sheet jacket 9 or side surface of the top side refractory plate 3 of the casting nozzle 1 that underlies that portion of the sheet jacket 9 (the same plane that defines the angle of inclination α). A similar angle of inclination is defined for centering element 5*a* on the opposite side of the abutting surface 7*b*.

These centering elements 5*a*, 5*b* or bevellings 4*a*, 4*b* are arranged and measured such that the abutting surfaces 7*a*, 7*b* of the top side plate 3 lying therebetween are each measured to be greater than the hole diameter 8 of the flow through 6 of the casting nozzle 1. It is thereby achieved that, during a change, the remaining molten steel in the base plate or the inlet nozzle above the top side plate 3, which has the same hole diameter, cannot flow between the casting nozzles 1, 10.

At least the top side plate 3 is surrounded with a sheet jacket 9 which is designed as a metal glad or a cassette and advantageously extends all round the top side plate 3. This sheet jacket 9 could also include the tubular part 2 in the top part. The centering elements 5*a*, 5*b* are fixed, for example welded, onto the sheet jacket 9 as curved sheets or blocks. They are preferably dimensioned approximately the same as the plate thickness in order to reduce the load per surface. However, as with the sheet jacket 9, they are moved back slightly from the top sliding surface 3'. The bevellings 4*a*, 4*b* are advantageously surrounded by the sheet jacket 9.

According to FIG. 3, in the abutting surfaces 7*a*, 7*b* formed from the refractory material of the top side plate 3, the width 9' of a metallic sheet jacket 9 is reduced vis-à-vis the two other side surfaces, and the abutting surfaces 7*a*, 7*b* protrude vis-à-vis this sheet jacket 9 in the top sliding surface 3', and it is thus guaranteed that, during a change, the one abutting surface is always in tight contact with the other abutting surface of an adjacent casting nozzle. In this connection, care is to be taken that the dimensions of the centering elements 5*a*, 5*b* and of the bevellings 4*a*, 4*b* corresponding thereto are chosen such that they do not cause the abutting surfaces 7*a*, 7*b* to be spaced apart from one another during a change.

The angles of inclination α and β may vary according to conditions. However, in any case they are intended to be dimensioned such that, during the changing process, the new casting nozzle cannot catch with the casting nozzle being replaced by becoming wedged. In principle, these angles of inclination can be approximately up to 80° or 10°.

Figure 4:
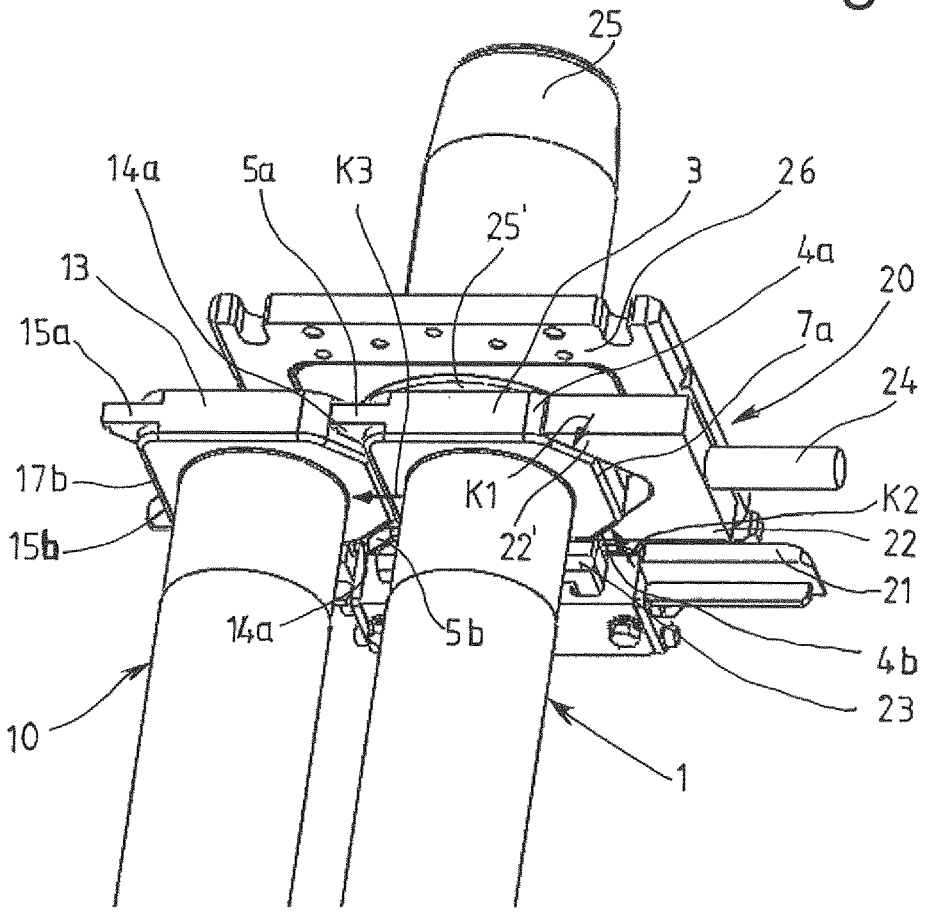
FIG. 4 is a perspective view of two casting nozzles in a changing device according to the invention, whereas only the rear mechanical sliding means of the device are in principle showed.

FIG. 4 shows the above-mentioned casting nozzle 1 during a change, in which, for example, it is being pushed into the casting position in the place of a casting nozzle 10 located in this position.

According to the invention, during a change, the casting nozzle 1 cooperates with its centering elements 5*a*, 5*b* with the bevellings 14*a*, 14*b* of the adjacent identically designed casting nozzle 10, and thus an approximately fixed guiding of the two casting nozzles results. The centering elements 5*a*, 5*b* with their contact surfaces are each provided with a similar angle of inclination α, β as the bevellings.

The casting nozzles 1, 10 are replaced in particular by means of a changing device 20, which has known mechanical guiding means 21, lifting push means, preferably spring-loaded rockers 23, and a linear actuator with a push rod 24 and frontally a U-shaped shoe 22 with guide elements 22'.

To form the outflow for the molten material, a refractory inlet nozzle 25 is mounted in replaceable manner in the outlet of a metallurgical vessel and a bottom plate 26 of the changing device 20, through which the casting nozzle 1 can be positioned in casting position below the inlet nozzle 25, for a casting. In so doing, the guiding means 21 and the spring-loaded rockers 23 grip around the top side plates 3, 13 of the casting nozzles 1, 10 and press same against the sliding surface 25' of the inlet nozzle 25, wherein they can be displaced along these sliding surfaces. Conventionally, during a change, the casting nozzle 10 is pushed out and can then be removed from the ingot mould.

Within the framework of the invention, the push rod 24 of the linear actuator of the changing device 20 is designed at the front side with the guide elements 22' which engage in the bevellings 4*a*, 4*b* of the casting nozzle 1 and push inwards along the plane of the plate, against the top side plate 3, with pushing forces K1, K2 indicated by the arrows. An additional guiding effect is thus achieved on the casting nozzles 1, when pushing in same as a new dipping tube and it can thus be inserted and centered with precision without wobbling or shaking movements of same.

Figure 5:
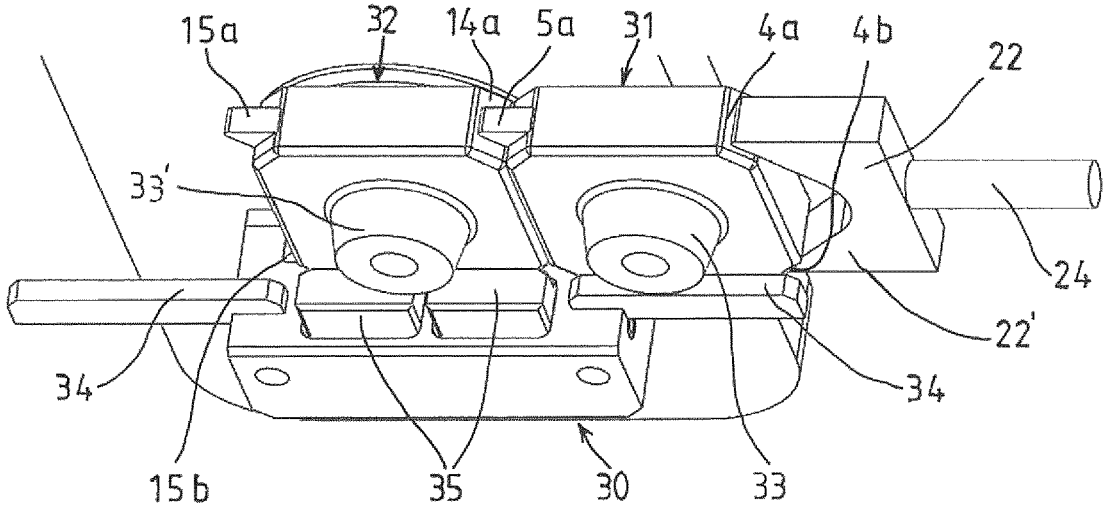
FIG. 5 is a perspective view of two metering nozzles in a changing device according to the invention, whereas also only the rear mechanical sliding means of the device are in principle showed.

FIG. 5 shows a changing device 30 with so-called refractory metering nozzles 31, 32, where the plates are designed exactly according to the invention at the top side, but shorter nozzles 33, 33' are provided in the place of tubes, as in FIG. 1. For the same elements respectively parts of this changing device 30 are used the same reference numbers like in FIG. 4, which are therefore not anymore explained again. The mechanical guiding means 34, spring-loaded rockers 35, and a linear actuator with a push rod 24 and frontally a U-shaped shoe 22 with guide elements 22' are provided like with device of FIG. 4. These metering nozzles 31, 32 can be inserted and centered with precision without wobbling or shaking movements of same as well.

The invention is explained sufficiently using the above embodiment example. It could, however, self-evidently be explained using other variants. To form the outflow for the molten material, a refractory base plate and/or an inlet nozzle is mounted in replaceable manner in the changing device, through which a casting nozzle can be positioned in casting position below the base plate or the inlet nozzle, for a casting. The centering elements in the plate could also be designed differently, such as for example as protruding bars or the like. The centering elements can be shaped symmetrically or asymmetrically.

Principally the abutting surfaces could also be made with a simpler embodiment, where only this metallic sheet jacket 9 would be surrounding the plate 3 without these formed protruding refractory materials in the top sliding surface 3', what is not showed. The metallic sheet jacket 9 would extend at the abutting surfaces almost up to this top sliding surface 3'.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A refractory casting nozzle, comprising:

a tubular part;

a top side refractory plate on a top side of the tubular part and which includes front and rear abutting surfaces on opposite front and rear end faces, a first lateral side surface and a second lateral side surface on an opposite side of the top side refractory plate from the first lateral side surface, the front abutting surface having an end region alongside the first lateral side surface and another end region alongside the second lateral side surface and the rear abutting surface having an end region alongside the first lateral side surface and another end region alongside the second lateral side surface;

two centering elements protruding outward from the front abutting surface, each of the two centering elements protruding outward on a respective one of the two end regions of the front abutting surface; and a sheet jacket on the first and second lateral side surfaces and part of the front and rear abutting surfaces, the top side refractory plate including two bevellings each on a respective one of the two end regions of the rear abutting surface, the bevelling and the centering element on the end regions of the front and rear abutting surfaces alongside the first lateral side surface having a cooperating profile and the bevelling and the centering element on the end regions of the front and rear abutting surfaces alongside the second lateral side surface having a cooperating profile, the sheet jacket having a width between upper and lower surfaces of the top side refractory plate in portions on the front and rear abutting surfaces that is less than a width in portions on the first and second lateral side surfaces, and the front and rear abutting surfaces protrude beyond the sheet jacket and provide contact surfaces of the top side refractory plate adjacent the upper surface of the top side refractory plate.

2. The refractory casting nozzle according to claim 1, wherein the top side refractory plate has a first corner region between the front abutting surface and the first lateral side surface, a second corner region between the front abutting surface and the second lateral side surface, a third corner region between the rear abutting surface and the first lateral side surface, a fourth corner region between the rear abutting surface and the second lateral side surface, each of the centering elements being in a respective one of the first and second corner regions and each of the bevellings being in a respective one of the third and fourth corner regions.

3. The refractory casting nozzle according to claim 2, wherein the cooperating profile of the bevelling and the centering element on the end regions of the front and rear abutting surfaces alongside the first lateral side surface and the cooperating profile of the bevelling and the centering element on the end regions of the front and rear abutting surfaces alongside the second lateral side surface is provided by the bevellings having an angle of inclination which is the same as an angle of inclination of a contact surface of the centering elements.

4. The refractory casting nozzle according to claim 3, wherein the angle of inclination of each of the bevellings and of the contact surfaces of each of the centering elements is between 30° and 60°.

5. The refractory casting nozzle according to claim 3, wherein the angle of inclination of each of the bevellings and of the contact surfaces of each of the centering elements is 45°.

6. The refractory casting nozzle according to claim 1, wherein the centering elements are part of the sheet jacket.

7. The refractory casting nozzle according to claim 1, wherein the centering elements are fixed to the sheet jacket.

8. The refractory casting nozzle according to claim 1, wherein the bevellings being are surrounded by the sheet jacket.

9. The refractory casting nozzle according to claim 1, wherein the sheet jacket is a metallic sheet jacket.

10. The refractory casting nozzle according to claim 1, wherein the top side refractory plate further includes a sliding surface on a top configured for contact with a refractory base plate and wherein an upper edge of the sheet jacket alongside the abutting surfaces is spaced from the sliding surface.

11. The refractory casting nozzle according to claim 1, wherein the cooperating profile of the bevelling and the centering element on the end regions of the front and rear abutting surfaces alongside the first lateral side surface and the cooperating profile of the bevelling and the centering element on the end regions of the front and rear abutting surfaces alongside the second lateral side surface enables contact between the bevellings on the refractory casting nozzle and centering elements on an additional refractory casting nozzle having the same construction as the refractory casting nozzle and contact between the centering elements on the refractory casting nozzle and bevellings on another additional refractory casting nozzle having the same construction as the refractory casting nozzle.

12. The refractory casting nozzle according to claim 1, wherein a length of the front abutting surface between the centering elements and a length of the rear abutting surface between the bevellings are greater than a hole diameter of a flow through in a center of the tubular part.

13. The refractory casting nozzle according to claim 1, wherein the top side refractory plate further includes a sliding surface on a top configured for contact with a refractory base plate and bearing surfaces on a bottom configured for contact with mechanical guiding and lifting push means of a changing device.

14. The refractory casting nozzle according to claim 1, wherein the angles of inclination of the bevellings are configured such that, during a change by a drive mechanism of a changing device, pushing forces acting upon the refractory casting nozzle are directed toward a center of a flow through of the tubular part.

15. The refractory casting nozzle according to claim 1, wherein each of the centering elements includes an angled contact surface.

16. In a changing device at the outlet of a metallurgical vessel including mechanical guiding means, lifting push means, a linear actuator with a push rod and a refractory base plate or an inlet nozzle, the improvement comprising:

the refractory casting nozzle of claim 1 being movable by the changing device into a casting position below the refractory base plate or the inlet nozzle and away from the casting position, the push rod including a U-shaped shoe with guide elements on a front side that are configured to engage the bevellings of the top side refractory plate of the refractory casting nozzle and, when striking the bevellings, exert forces that act in a direction inward into the top side refractory plate.

17. The improvement to the changing device according to claim 16, wherein the top side refractory plate further includes a sliding surface on a top configured for a sealing contact with the refractory base plate or the inlet nozzle and bearing surfaces on a bottom configured for contact with the mechanical guiding means and lifting push means of the changing device.

* * * * *